United States Patent [19]

Doonan

[11] 4,452,459

[45] Jun. 5, 1984

[54] ARROWHEAD

[76] Inventor: William Doonan, 1978 Shady Shores, Lupton, Mich. 48635

[21] Appl. No.: 419,445

[22] Filed: Sep. 17, 1982

[51] Int. Cl.[3] ..... F41B 5/02

[52] U.S. Cl. ..... 273/422

[58] Field of Search ..... 273/421, 422, 419, 420; 30/301, 302, 337–339

[56] References Cited

U.S. PATENT DOCUMENTS

| | | | |
|---|---|---|---|
| 2,137,014 | 11/1938 | Brochu | 273/422 X |
| 3,401,938 | 9/1968 | Bear | 273/421 X |
| 3,741,542 | 6/1973 | Karbo | 273/422 |
| 4,029,319 | 6/1977 | Christen | 273/422 |
| 4,349,202 | 9/1982 | Scott | 273/422 |

*Primary Examiner*—Paul E. Shapiro

*Attorney, Agent, or Firm*—Michael L. Bauchan

[57] ABSTRACT

An arrowhead is provided which is comprised of a cylindrical arrowhead shaft, a primary blade and a secondary blade. A longitudinal slot and two longitudinal grooves are provided in the front end of the shaft for holding the blades at right angles to each other. The rear end of the shaft is adapted for insertion in an arrow shaft. Proximate the rear end of the arrowhead shaft is a conical column support which abuts the end of the arrow shaft so as to distribute axial forces in the arrowhead shaft over the end of the arrow shaft. In front of the column support is a conical gauging circle having index slots in which the blades are supported. Guide edges which diverge rearwardly are provided on each of the blades to guide the blades into the index slots. The primary blade holds the secondary blade on the cylindrical shaft and is provided lock tabs which engage the rear surface of the gauging circle to resist primary blade removal.

7 Claims, 6 Drawing Figures

ARROWHEAD

BACKGROUND OF THE INVENTION

This invention pertains to a unique arrowhead construction comprised of a cylindrical arrowhead shaft and a blade assembly which may be attached to arrow shafts in common usage.

Many arrowhead configurations have been developed over hundreds of years and with the development of modern technology arrowhead construction has become quite sophisticated, some examples of which are disclosed in Doonan U.S. Pat. No. 2,912,247; Simo U.S. Pat. No. 4,175,749; Simo U.S. Pat. No. 4,006,901; Kosbab U.S. Pat. No. 4,210,330; and Sherwin U.S. Pat. No. 4,036,499.

In addition to the aforementioned patents the inventor has also used a cylindrical arrowhead shaft on which primary and secondary blades are secured at right angles to each other with the blades secured at the front of the shaft in a slot and grooves and being positioned at the rear of the shaft in a notched blade support, the blades having an open center section to facilitate good aerodynamic flight characteristics while the arrowhead rotates in flight.

The aforedescribed arrowhead configurations are generally functional but are not optimum. The inventor has recognized the need for an arrowhead which may be inserted in a hollow arrow shaft and which can distribute axial forces in the arrowhead over the end of an arrow shaft into which the arrowhead is inserted while providing a lightweight arrowhead having good flight characteristics attainable only with a slender arrowhead shaft and open blades. The inventor has also recognized that when inserting a blade into a slot or pair of grooves on the front of an arrowhead shaft and supporting the rear end of the blades in a gauging circle it is necessary to provide a means for guiding the blades into index slots in the gauging circle to facilitate assembly in an automatic operation and to provide lock tabs to resist blade removal once assembled.

BRIEF SUMMARY OF THE INVENTION

The arrowhead construction of Applicant maintains the slender cylindrical arrowhead shaft and open blade construction of the prior art as set forth above but provides an annular column support in the shape of a cone proximate the rear end of the cylindrical shaft so that when the rear end of the shaft is inserted in an arrow shaft the column support spreads axial forces in the arrowhead over the end surface of the arrow shaft. Applicant also provides a blade support in the form of a conical gauging circle in front of the column support for supporting primary and secondary blades in index slots and provides each of the blades with guide edges which diverge rearwardly so that when the blades are inserted in grooves and a slot at the front end of the cylindrical shaft the guide edges guide the blades into the index slots. Lock tabs on the primary blade engage the rear surface of the gauging circle so as to prevent its disassembly and the primary blade retains the secondary blade in the assembled position.

It is thus an object of this invention to provide an arrowhead construction which utilizes a slender cylindrical shaft and open blades to provide good flight characteristics and which is designed for insertion of the cylindrical shaft into a tubular arrow shaft and which distributes axial forces over the end surface of the tubular arrow shaft.

It is a further object of this invention to provide an arrowhead construction utilizing a cylindrical shaft and open blades held by a slot and grooves at the front of the arrowhead and held by a conical blade support gauging circle which tapers forwardly and on which are located index slots in which rearwardly diverging blade guide edges guide blade support surfaces when the blades are moved axially in the said slot and grooves and in which at least one of the blades is retained by tabs which engage the rear surface of the gauging circle.

DESCRIPTION OF THE PREFERRED EMBODIMENT

Figure 1:
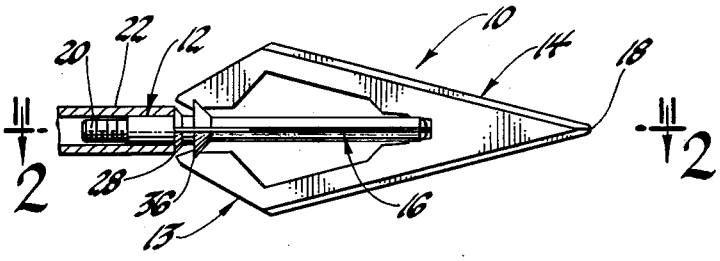
FIG. 1 is a side view of an arrowhead embodying the principles of the subject invention.
Figure 2:
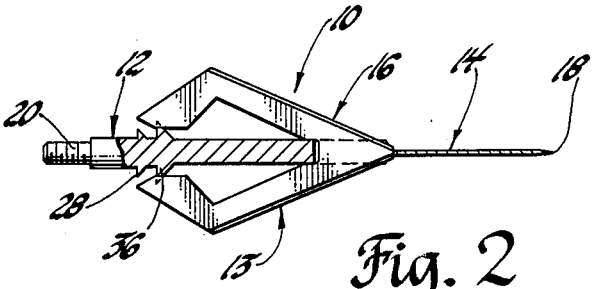
FIG. 2 is a partial cross section view of the arrowhead in FIG. 1 along the lines 2—2.

An arrowhead assembly 10 embodying the principles of the subject invention is shown in FIG. 1. The arrowhead assembly 10 is comprised of a cylindrical arrowhead shaft 12 and a blade assembly 13 comprising a thin, substantially two-dimensional primary blade 14 and a secondary blade 16 of the same thickness. The arrowhead assembly 10 front end is a point 18 on the primary blade 14 and its rear end is a threaded section 20 on the shaft 12.

As persons versed in the art will appreciate, there are many conventional ways for attaching an arrowhead to an arrow shaft. Doonan U.S. Pat. No. 2,912,247 discloses a way in which the arrow shaft is inserted inside a receiving end of an arrowhead. Simo U.S. Pat. No. 4,175,749 and the other aforementioned patents illustrate how a part of an arrowhead is sometimes inserted within an arrow shaft either with or without an adapter. For purposes of illustration part of an arrow shaft 22 is shown in FIG. 1 with the connecting end of shaft 12 inserted in a tubular end of the arrow shaft 22 which is adapted for receiving an arrowhead and which is defined by a certain inside and outside diameter. The illustration in FIG. 1 of the arrow shaft 22 is by way of example and is not intended to be limiting in any way nor intended to be the exclusive way in which the arrowhead assembly 10 embodying the ptinciples of the subject invention may be attached to an arrow shaft 22. Indeed, for purposes of this specification and the claims which follow the term "arrow shaft" is to be broadly construed as persons versed in the art will appreciate that the arrowhead assembly 10 is intended to be manufactured in large volume as a general purpose arrowhead which may be used on numerous arrow shafts either with or without adapters and accordingly the term "arrow shaft" as used in the specification and appended claims is to include any arrow shafts and adapters which may be used in conjunction with the arrowhead assembly 10 to accommodate various size and configuration arrow shafts.

Figure 3:
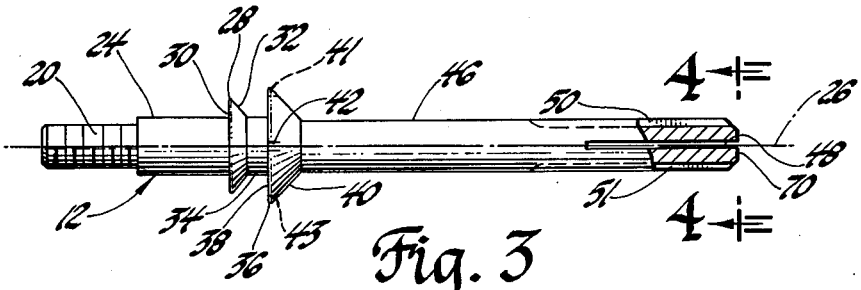
FIG. 3 is a side view with parts removed of the cylindrical shaft employed by the arrowhead in FIG. 1.

FIG. 3 is an enlarged view of the cylindrical arrowhead shaft 12 provided to show its various details. The threaded section 20 at the rear of the shaft 12 is a standard thread common in the industry. Immediately in front of the threaded section 20 is a cylindrical section 24 which in the illustrated embodiment has a certain outside diameter approximately equal to the inside diameter of the tubular end of the arrow shaft 22 in which the shaft 12 is inserted in FIG. 1.

The shaft 12 may be defined by a longitudinal axis 26. An annular conical column support 28 is formed in the shaft 12 so as to extend radially outward from the axis 26. The rear surface 30 of the column support 28 is at right angles to the axis 26. The front surface 32 tapers toward the axis 26 in the forward direction in the shape of a cone which is truncated at its junction with the cylindrical section 34 of the shaft 12.

In front of the column support 28 is an annular conical blade support 36 which functions as a gauging circle to retain the rear ends of the blades 14 and 16. The blade support 36 extends radially from the axis 26 and includes a rear surface 38 substantially at right angles to the axis 26 and a conical front surface 40. Four equispaced index slots 41–44 are formed in the outer perimeter of the blade support 36. For reasons which will become apparent the bottoms of the index slots 41–44 are at a depth such that the bottoms of the opposing index slots are at a certain predetermined distance from each other.

The conical front surface 40 of the blade support 38 is truncated where it intersects an elongated blade support section 46 of the shaft 12. Persons versed in the art will appreciate that axial forces along the axis 26 in the shaft 12 caused when the arrowhead assembly 10 strikes a target, particularly where it strikes a hard object such as a bone in a large animal, will tend to be less in front of the blade support 36 than behind the blade support 36. Accordingly, the blade support section 46 in the illustrated embodiment has a somewhat smaller diameter than the diameters in sections 24 and 34, each of which are equal. Persons versed in the art will appreciate that the smaller diameter blade support section 46 and the open areas in the blades 14 and 16 keep weight of the arrowhead assembly 10 to a minimum while increasing flight characteristics as the arrowhead assembly 10 spins on the axis 26 toward a target, the weight reduction reducing the moment of inertia and the open spaces reducing air turbulence of the spinning arrowhead assembly 10.

Figure 4:
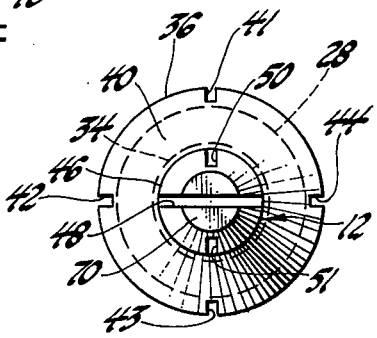
FIG. 4 is an end view of the cylindrical shaft in FIG. 3.

At the front end the shaft 12 is provided with a slot 48 extending longitudinally on the axis 26 and a pair of grooves 50 and 51 on opposite sides of the slot 48 and cut at right angles to the slot 48. As shown in FIG. 4, two of the index slots 42 and 44 are aligned with the slot 48 and the other two of the index slots 41 and 43 are aligned with the grooves 50 and 51.

Figure 5:
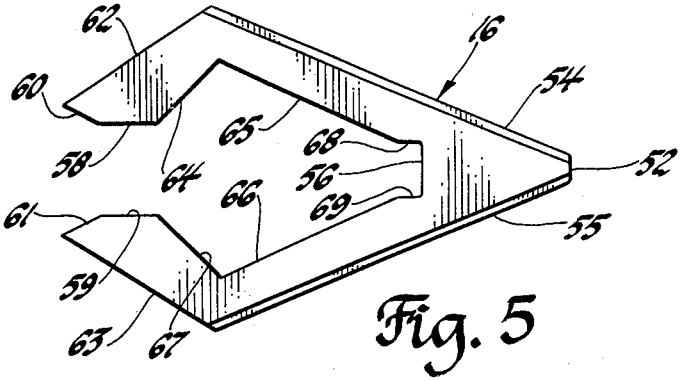
FIG. 5 is a side view of the secondary blade employed by the arrowhead in FIG. 1.

As shown in FIG. 5, the secondary blade 16 has a front edge 52 which connects two knife edges 54–55 which diverge rearwardly. A rear edge 56 in the illustrated embodiment is provided at right angles to the axis 26 and is parallel to the front edge 52. Support edges 58–59 are provided parallel to the axis 26 and are spaced a certain predetermined distance which in the illustrated embodiment is substantially equal to the distance between the bottoms of the index slots 42 and 44 in the perimeter of the blade support 36. The support edges 58–59 join guide edges 60–61 which diverge rearwardly. Connecting edges 62–63 connect the knife edges 54–55 to the guide edges 60–61, respectively. Interior edges 64–69 connect the support edges 58–59 to the rear edge 56. In the illustrated embodiment the distance separating rear edge 56 from front edge 52 is selected to be approximately equal to the depth of the slot 48 so the front edge 52 is substantially flush with the end surface 70 of the shaft 12 when the secondary blade 16 is attached to the shaft 12 as shown in FIG. 1.

Figure 6:
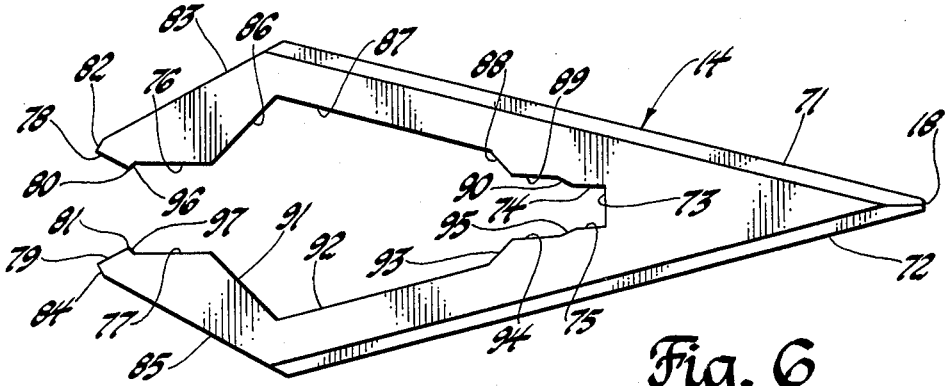
FIG. 6 is a side view of the primary blade employed by the arrowhead in FIG. 1.

As shown in FIG. 6, the primary blade 14 has two knife edges 71–72 diverging rearwardly from point 18 and has a rear edge 73 at right angles to axis 26. Front blade support edges 74–75 on each side of rear edge 73 are spaced a predetermined distance which is approximately equal to the diameter of the shaft 12 at the bottom of the grooves 50–51 in which the front blade support edges 74–75 are inserted as shown in FIG. 1. Rear blade support edges 76–77 are provided in the primary blade 14 separated by a certain predetermined distance substantially equal to the diameter of the shaft 12 at the base of index slots 41–43 in the blade support 36. Guide edges 78–79 are provided at the rear of primary blade 14 and are connected to the rear blade support edges 76–77 by lock tabs 80–81 provided to engage the rear surface 38 of blade support 36 when the rear blade support edges 76–77 engage index slots 41 and 43. Connecting edges 82–83 connect guide edge 78 to knife edge 71 and connecting edges 84–85 connect guide edge 79 to knife edge 72. Interior edges 86–95 connect the rear blade support edges 76–77 to the rear edge 73.

The arrowhead assembly 10 is assembled by first mounting the secondary blade 16 on the shaft 12 by axially sliding the rear edge 56 of the secondary blade 16 into slot 48. As the rear end of the secondary blade 16 encounters the conical blade support 36 the guide edges 60–61 enter the slots 42 and 44 so as to guide support edges 58 and 59 into the slots 42 and 44 to the position illustrated in FIG. 1. In that position the front edge 52 of the secondary blade 16 is substantially flush with the end surface 70 of the shaft 12. The primary blade 14 is then attached to the shaft 12 by sliding front blade support edges 74–75 into grooves 50–51 axially rearward. As the guide edges 78–79 encounter blade support 36 they enter index slots 41 and 43. Lock tabs 80–81 project radially inward toward axis 26 so they are closer than the distance between rear blade support edges 76–77. Thus sufficient force must be used to press blade 14 onto shaft 12 so as to force lock tabs 80–81 through index slots 41 and 43 until rear blade support edges 76–77 rest on the bottoms of index slots 41 and 43 and the lock tabs 80 and 81 engage the rear surface 38 of blade support 36. In the preferred embodiment the shaft 12 may be made of aluminum or steel and the blades 14 and 16 are made of spring steel which flexes sufficiently to permit spreading the lock tabs 80–81 as they pass up the conical front surface 40 and through index slots 41 and 43 of blade support 36. In the illustrated embodiment the tabs 80–81 have front sloped surfaces 96–97 which diverge forwardly at approximately a 45° angle so the tabs 80–81 engage the rear surface 38 of blade support 36 tight enough to retain the primary blade 14 on the shaft 12 while still permitting disassembly of the arrowhead assembly 10 by firmly pulling primary blade 14 axially to the front of the arrowhead assembly 10, causing front sloped surfaces 96 and 97 to enter the index slots 41 and 43. Disassembly thus is the reverse of the assembly steps.

Once the primary blade 14 is securely held on the shaft 12 its rear edge 73 intersects the front edge 52 of the secondary blade 16 so as to prevent removal of the secondary blade 16 without first removing the primary blade 14. Thus lock tabs are not required on the secondary blade 16.

The air spaces between the shaft 12 and the primary blade 14 and secondary blade 16 interior edges permit the passage of air between the blades 14 and 16 and the shaft 12, thereby reducing air turbulence as the arrowhead assembly 10 spirals in flight toward a target. Upon impacting a hard object such as a large bone in a large animal the impact forces encountered in the front end of the arrowhead assembly 10 are transmitted through the blade support 36 and cylindrical section 34 to the column support 28, which distributes the forces over the end of the arrow shaft 22 so as to provide more column strength than would be possible without the column support 28. The column support 28 and blade support 36 in the preferred embodiment are conical so as to optimize flight characteristics and provide an inclined surface which facilitates automatic assembly of the arrowhead assembly as the guide edges 60–61 and 78–79 are inserted in index slots 41–44. In the arrowhead shaft a cylindrical column is employed in which all cross sections are circles other than those cross section parts taken through slots or grooves. While the illustrated arrowhead shaft 12 is the preferred shaft configuration other shaft configurations may be employed without departing from the spirit of the invention.

The blades 14 and 16 in the illustrated embodiment are for purposes of illustration and are preferred designs for providing the required strength in each blade part while keeping weight to a minimum and maintaining good flight characteristics. While the blade support edges described herein are stated to be approximately spaced the same dimension as the arrowhead shaft 12 diameter where the blade edges are supported, persons versed in the art will appreciate that in manufacturing the arrowhead shaft 12 and blades 14 and 16 the manufacturing is imperfect and plus or minus tolerances are used. In the preferred embodiment these tolerances are selected to assure a snug fit between the arrowhead shaft 12 and blades 14 and 16, which may necessitate slightly spreading the rear ends of the blades 14 and 16 in constructing the arrowhead assembly 10. It is thus apparent that the rearwardly diverging guide edges at the rear ends of blades 14 and 16 can greatly facilitate rapid automatic assembly of the arrowhead asembly 10 as they slide toward conical front surface 40 of blade support 36.

What is claimed is:

1. An arrowhead comprising, in combination, a blade assembly and an arrowhead shaft defined by an axis, said blade assembly being defined by front and rear ends, said arrowhead shaft including a rear end adapted for insertion in an end of a tubular arrow shaft, a front end adapted for supporting said front and rear ends of said blade assembly, connecting means connecting said front and rear arrowhead shaft ends, and a column support positioned rearward of said rear end of said blade assembly and extending radially outward from said connecting means substantially perpendicular to said axis proximate said arrowhead shaft rear end so as to abut a tubular arrow shaft end into which said arrow shaft rear end is inserted whereby axial forces in said arrowhead shaft are distributed through said column support across said arrow shaft end.

2. An arrowhead comprising, in combination, a blade assembly and a shaft defined by an axis and having a rear end adapted for connection to an arrow shaft and a front end adapted for supporting said blade assembly, said shaft front end including a conical blade support proximate said rear end and attachment means in front of said blade support for supporting a blade, said blade support including a radially extending rear surface, a forwardly narrowing conical front surface, and at least two index slots in the perimeter of said blade support, said blade assembly including at least one blade having front and rear ends, two rearwardly diverging knife edges connected at said front end, two support edges adapted for insertion in said index slots, and a guide edge proximate each of said support edges and diverging rearwardly of said support edges for guiding said support edges into said index slots as said blade is moved axially rearward on said shaft.

3. An arrowhead comprising, in combination, a blade assembly and a shaft defined by an axis and having a rear end adapted for connection to an arrow shaft and a front end adapted for supporting said blade assembly, said shaft front end including a conical blade support proximate said rear end, and attachment means in front of said blade support for supporting a blade, said blade support including a radially extending rear surface, a forwardly narrowing conical front surface, and at least two index slots in the perimeter of said blade support, said blade assembly including at least one blade having front and rear ends, two rearwardly diverging knife edges connected at said front end, two support edges adapted for insertion in said index slots, a guide edge proximate each of said support edges and diverging rearwardly of said support edges for guiding said support edges into said index slots as said blade is moved axially rearward on said shaft, and at least one lock tab between one of said support edges and one of said guide edges, said lock tab extending radially inward toward said axis for engaging said blade support rear surface when said one guide edge is in one of said index slots so as to resist removal of said blade when said blade is axially moved forward.

4. An arrowhead assembly for use in combination with an arrow shaft having a tubular receiving end defined by certain inside and outside diameters comprising, in combination, a blade assembly comprising front and rear blade assembly ends and an arrowhead shaft comprising a front blade support end, a rear arrow shaft connecting end, and connecting means connecting said front blade support end and said rear arrow shaft connecting end, said arrowhead shaft including a cylindrical shaft section adapted for insertion in said arrow shaft tubular receiving end and an annular column support on said cylindrical shaft section extending radially from said connecting means rearward of said rear blade assembly end and having a certain diameter, said certain diameter being approximately equal to said tubular receiving end outside diameter, and a surface on said annular column support adapted to abut said arrow shaft tubular receiving end, said blade assembly front and rear ends being supported on said arrowhead shaft blade support end in front of said annular column support.

5. An arrowhead assembly comprising, in combination, a shaft defined by a longitudinal axis and comprising front and rear ends and an annular gauging circle proximate said rear end, said gauging circle extending radially from said shaft and having four equally spaced index slots in the perimeter of said gauging circle, a rear surface extending radially from said shaft and a conical surface tapering toward said front end, said front end having a longitudinal slot through said shaft aligned with two of said index slots and two grooves on the outside surface of said front end aligned with the other two of said index slots, said grooves being on opposite sides of said slot, each of said grooves being parallel to said axis and spaced equal distances from each side of said slot; a secondary blade having a front end at which two knife edges diverge rearwardly and a rear end having two support edges which are substantially parallel to said axis and are separated by a distance approximately equal to the distance between opposite index slots and guide edges which diverge rearwardly so as to facilitate guiding said support edges into two of said index slots and a rear edge adapted for insertion into said longitudinal slot; a primary blade having a front end at which two knife edges diverge rearwardly and which includes two front support edges adapted to be inserted in said longitudinal grooves on said shaft front end and a rear end having two primary blade support edges parallel to said axis and spaced by a distance approximately equal to the distance between said other two index slots, guide edges which diverge rearwardly from said primary blade support edges so as to facilitate guiding said primary blade support edges into said other two index slots and a tab connecting each of said primary blade guide edges to one of said primary blade support edges, each of said tabs being adapted to engage said gauging circle rear surface so as to lock said primary blade into said grooves.

6. An arrowhead assembly having a front end for piercing a target and a rear end adapted for connection to an arrow shaft comprising, in combination, a shaft having a longitudinal axis, a primary blade and a secondary blade; said shaft including a longitudinal slot on said axis in said front end, two longitudinal grooves parallel to said axis on opposite sides of said slot and equally spaced from each edge of said slot and a conical blade support radially extending from said shaft and having a rear surface substantially at right angles to said axis, a front surface tapering forwardly toward said axis and four index slots equispaced in the perimeter of said blade support, two of said index slots being aligned with said grooves and two of said index slots being aligned with said slot; said secondary blade including first and second knife edges diverging rearwardly from said front end, two substantially parallel edges for engaging two of said index slots on opposite sides of said shaft when said secondary blade is inserted in said front end slot and two guide edges diverging rearwardly from said parallel edges so as to guide said parallel edges into two of said index slots when said secondary blade is moved axially rearward into said front end slot; said primary blade including first and second knife edges diverging rearwardly from said front end, two front support edges parallel to said axis adapted for insertion in said front grooves, two rear support edges parallel to said axis for engaging two of said index slots on opposite sides of said shaft when said primary blade is inserted in said front grooves, two guide edges diverging rearwardly from said rear support edges so as to guide said rear support edges into two of said index slots when said primary blade front support edges are moved axially rearward into said front end grooves.

7. An arrowhead assembly having a front end for piercing a target and a rear end adapted for connection to a tubular arrow shaft end defined by a certain inside arrow shaft diameter and a certain outside arrow shaft diameter, comprising, in combination, an arrowhead shaft, a secondary blade and a primary blade; said arrowhead shaft being defined by a longitudinal axis and having a rear end cylindrical section having a certain diameter, said certain diameter being a diameter substantially equal to said arrow shaft inside diameter and adapted for insertion therein, an annular column support extending radially from said axis, said annular column support having a rear surface substantially at right angles to said axis and having a second certain diameter, said second certain diameter being substantially equal to said outside arrow shaft diameter and adapted to abut said tubular arrow shaft end, an axial slot in said front end of said arrowhead shaft for receiving said secondary blade, two grooves in said arrowhead shaft front end on opposite sides of said slot for receiving said primary blade, and an annular blade support in front of said annular column support for supporting and retaining said blades on said arrowhead shaft, said annular blade support including a rear surface extending radially and substantially at right angles to said axis, a conical front surface tapering forwardly toward said axis, and four index slots equispaced in the perimeter of said blade support, the first two of said index slots being axially aligned with said front end slot and the second two of said index slots being axially aligned with said axial slot; said secondary blade having a front end, two knife edges diverging rearwardly from said secondary blade front end, a rear edge opposite said front end for insertion in said axial slot, two support edges parallel to said axis for insertion in two of said index slots, two guide edges proximate said support edges and diverging rearwardly so as to guide said support edges into said index slots as said secondary blade is inserted in said front slot, said secondary blade front end being proximate said arrowhead shaft front end when said secondary blade rear edge is inserted in said axial front slot and said secondary blade support edges engage two of said index slots; said primary blade including two knife edges diverging rearwardly from the front of said primary blade, a rear edge proximate said secondary blade front end, first and second front support edges proximate said primary blade rear edge and each being adapted to engage one of said grooves and first and second rear support edges substantially parallel to said axis and each being adapted to engage one of said index slots, a guide edge proximate each of said rear support edges diverging rearwardly for guiding said rear support edges across said blade support conical surface into one of said index slots, and at least one tab between one of said guide edges and one of said rear support edges for engaging said blade support rear surface when said primary blade front support edges engage said grooves, said primary blade rear support edges engage two of said index slots and said primary blade rear edge is proximate said secondary blade front end, thereby holding both said primary blade and said secondary blade on said arrowhead shaft.

* * * * *

UNITED STATES PATENT AND TRADEMARK OFFICE

CERTIFICATE OF CORRECTION

PATENT NO. : 4,452,459

DATED : June 5, 1984

INVENTOR(S) : William Doonan

It is certified that error appears in the above-identified patent and that said Letters Patent is hereby corrected as shown below:

Column 2, line 55, "ptinciples" should read -- principles --.

Column 5, line 63, "said arrow" should read -- said arrowhead --

Signed and Sealed this

*Sixth* Day of *November 1984*

[SEAL]

*Attest:*

GERALD J. MOSSINGHOFF

*Attesting Officer*

*Commissioner of Patents and Trademarks*